US009707446B2

(12) United States Patent
Zewolde

(10) Patent No.: US 9,707,446 B2
(45) Date of Patent: Jul. 18, 2017

(54) JUMP ALL

(71) Applicant: Michael Zewolde, Burtonsville, MD (US)

(72) Inventor: Michael Zewolde, Burtonsville, MD (US)

( * ) Notice: Subject to any disclaimer, the term of this patent is extended or adjusted under 35 U.S.C. 154(b) by 56 days.

(21) Appl. No.: 14/923,790

(22) Filed: Oct. 27, 2015

(65) Prior Publication Data

US 2016/0121168 A1 May 5, 2016

Related U.S. Application Data

(60) Provisional application No. 62/068,960, filed on Oct. 27, 2014.

(51) Int. Cl.

| | |
|---|---|
| ***A63B 5/20*** | (2006.01) |
| ***A63B 24/00*** | (2006.01) |
| ***A63B 71/06*** | (2006.01) |

(52) U.S. Cl.

CPC ..... *A63B 24/0087* (2013.01); *A63B 5/205* (2013.01); *A63B 71/0619* (2013.01); *A63B 2024/009* (2013.01); *A63B 2208/12* (2013.01); *A63B 2210/50* (2013.01); *A63B 2225/093* (2013.01)

(58) Field of Classification Search

CPC ... A63B 5/20; A63B 24/0087; A63B 2225/50; A63B 2220/51; A63B 2208/12; A63B 2071/0625; A63B 21/0058; A63B 21/00181; A63B 2220/16; A63B 2024/0093; A63B 2220/30; A63B 2220/805; A63B 22/0242; A63B 21/4035; A63B 22/0235; A63B 2220/17; A63B 24/0062; A63B 5/22; A63B 71/0622; A63B 5/16

USPC ..... 482/7, 81–82

See application file for complete search history.

(56) References Cited

U.S. PATENT DOCUMENTS

| | | | | |
|---|---|---|---|---|
| 2,911,063 A * | 11/1959 | Wolfson | A63B 5/20 185/37 |
| 3,013,798 A * | 12/1961 | Willoughby | A63B 5/20 273/DIG. 4 |
| 3,263,995 A * | 8/1966 | Morrow | A63B 5/20 482/7 |
| 3,595,571 A * | 7/1971 | Spinnett | A63B 5/20 482/81 |
| 4,082,266 A * | 4/1978 | Elkins | A63B 5/20 482/7 |
| 4,529,195 A * | 7/1985 | Stevens | A63B 5/20 482/1 |

(Continued)

*Primary Examiner* — Andrew S Lo

(57) ABSTRACT

A system for jumping rope comprising an electronic box with a rotatable circular groove to which a hook is anchored to hold one end of a jump rope, with the other end of the jump rope hooked on to one of a plurality of hooks anchored to a telescoping pole mounted on a tripod with rotatable wheels. The electronic box is mounted on a telescoping pole attached to a stand with rotatable wheels and a central pivot section to fold the structure for easy transport and storage. A remote control having a power button, speed control and a magic eye provides power to the electronic box through a second magic eye located on the electronic box, to rotate the circular groove and start the elliptical motion of the jump rope for the use of the participant.

7 Claims, 1 Drawing Sheet

(56) References Cited

U.S. PATENT DOCUMENTS

| | | | | | |
|---|---|---|---|---|---|
| 4,739,985 | A * | 4/1988 | Rudell | A63B 5/20 | 482/81 |
| 5,060,936 | A * | 10/1991 | Ekonen | A63B 5/20 | 482/81 |
| 5,167,599 | A * | 12/1992 | Haller | A63B 5/20 | 482/148 |
| 5,961,425 | A * | 10/1999 | Reid | A63B 5/20 | 482/81 |
| 6,645,123 | B1 * | 11/2003 | Davis | A63B 5/20 | 482/81 |
| 7,727,126 | B1 * | 6/2010 | Foster | A63B 5/20 | 482/81 |
| 2002/0123413 | A1 * | 9/2002 | Reid | A63B 5/20 | 482/81 |
| 2005/0020413 | A1 * | 1/2005 | Rudell | A63B 5/20 | 482/81 |
| 2005/0020414 | A1 * | 1/2005 | Rudell | A63B 5/20 | 482/81 |
| 2005/0164846 | A1 * | 7/2005 | Rudell | A63B 5/20 | 482/81 |
| 2010/0173756 | A1 * | 7/2010 | Lee | A63B 5/20 | 482/81 |

* cited by examiner

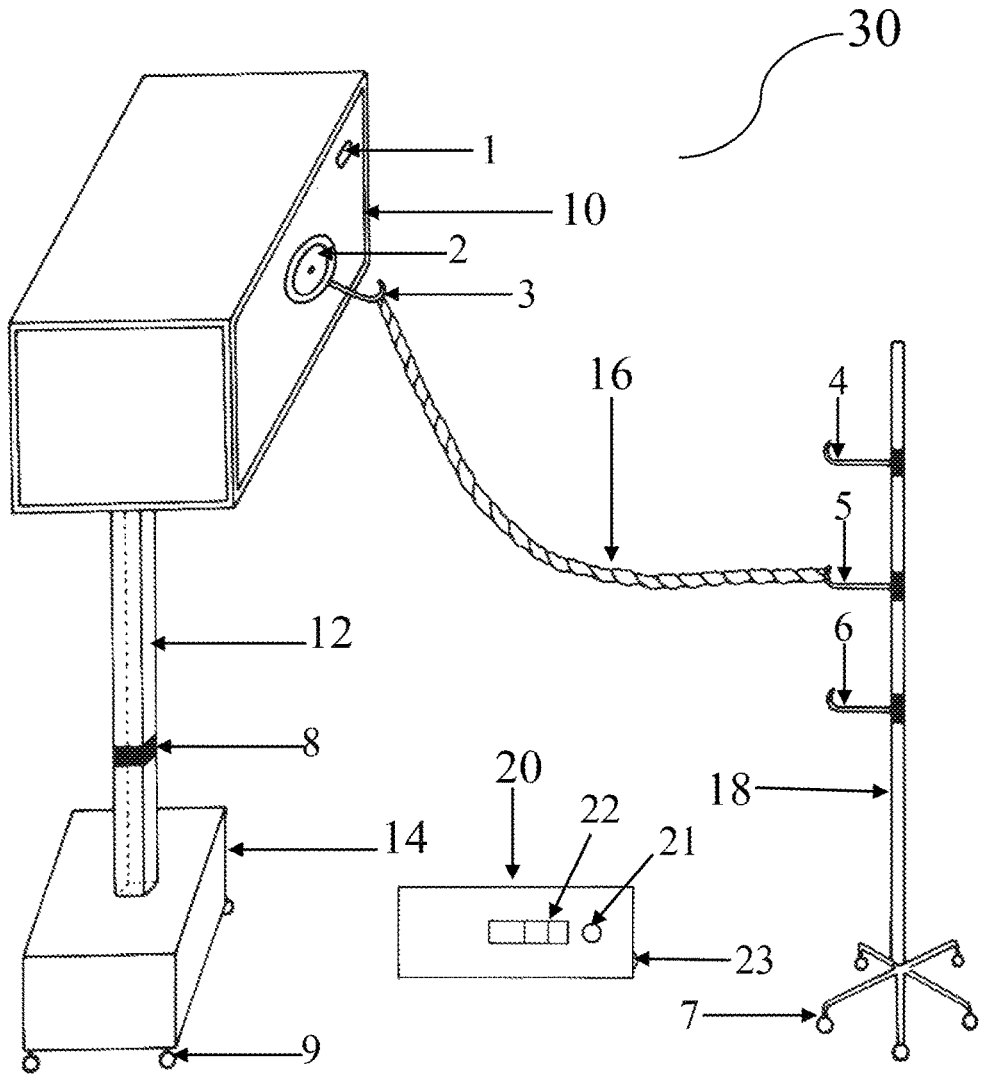
30
1
10
2
3
16
4
5
6
12
8
20
22
21
18
14
23
7
9

JUMP ALL

CROSS REFERENCE TO RELATED APPLICATION

This application claims priority under 35 USC 119 (e) to U.S. Provisional Patent Application Ser. No. 62/068,960 filed, Oct. 27, 2014, which is incorporated herein by reference, in its entirety.

FIELD OF THE INVENTION

The present invention is generally related to recreational games. More particularly, the invention is related to a system for jumping rope, a form of recreational game, without the assistance of others to hold the two rope ends, which is normally required to engage in the game of jump rope.

BACKGROUND OF THE INVENTION

Jumping rope is a recreational activity that has been in vogue for centuries, particularly enjoyed by young girls and more recently popular among adults and children of all ages and genders as both a recreational activity, as well as a means to stay physically fit. Jumping rope as a recreational activity generally involves two individuals holding the two ends of a rope and swinging that rope in a circular motion while a third person, a child or adult tries to jump over the rope as it is being swung under their feet and over their bodies. Thus the customary way for a participant to enjoy jumping rope requires the assistance of a minimum of two other individuals to hold the rope at the two ends and to swing the rope in an elliptical motion to enable the participant to jump over the rope.

There is a need in the prior art for a system that would enable a jump rope enthusiast to be able to enjoy the sport without the assistance of two other individuals to hold the ends of the rope and swing it around to enable the participant to jump the rope. The present invention provides such a system, device and method for jumping rope.

SUMMARY OF THE INVENTION

The present invention is a jump rope system that does not require the assistance or cooperation of others to hold the rope ends while the participant jumps the rope.

It is an object of the present invention to provide a system, device and method for jumping rope without additional manpower to hold the rope ends in order for a participant to enjoy the activity of jumping a rope.

Yet another object of the present invention is to provide a jump rope system that is collapsible for storage and light in weight so as to be easily carried and setup by one person to engage in the activity of jumping rope without assistance from others.

The exemplary embodiment of the invention is comprised of an electronic box mounted on a telescopic pole which is supported on a base stand having rotating wheels, the electronic box further having a circular rotating groove to which is attached a hook to hold one end of a jump rope, the other end of the jump rope being held by a hook mounted on a separate telescoping pole mounted on a tripod base with rotatable wheels. The rope is activated by a remote control box having the ability to control the speed of rotation of the rope that is desired by the participant.

These and other features and embodiments of the invention will become obvious when viewed in conjunction with the drawings of the invention accompanied by the detailed description of the exemplary devices of the invention, supported by the claims.

BRIEF DESCRIPTION OF THE DRAWINGS

FIG. 1 is a perspective view of the exemplary embodiment of the present invention.

DETAILED DESCRIPTION OF THE INVENTION

The present invention is a system and method that allows an adult or child to participate and enjoy the recreational sport of jump roping without the assistance of others to hold the ends of the rope while the person attempts to jump the rope. The system is comprised of distinct parts that are easily assembled by a child or adult to participate in the sport and dis-assembled and packaged to be stored, when not in use.

Referring now to the figures, more particularly to FIG. 1 the FIGURE shows a perspective view of the essential and distinct devices of the system 30 of the invention. The system 30 of the invention is comprised of an electronic box 10 mounted at the top end of a telescoping pole 12. The electronic box 10 generally stands about 3 to 4 feet tall, but may be adjusted to any desired height through extending or detracting the telescoping pole 12. The pole 12 has a central pivot section 8 that can be folded down with the top electronic box 10 still attached to it for compact storage of the entire device including the stand 14 which is attached to the bottom end of the pole 12. The stand 14 has a set of rotatable wheels 9 at the bottom end to facilitate moving the stand 14 holding the electronic box 10 of the system from one location to another, as needed. Stand 14 is box shaped or shaped like a tripod in some embodiments of the invention.

Referring again to FIG. 1 the electronic box 10 has a rotatable circular groove 2 to which a hook 3 is anchored. One end of a jump rope 16 is hooked on to hook 3 of the circular groove 2 and the other end of the jump rope 16 is attached to any one of hooks 4, 5, or 6 anchored to a separate telescoping pole 18 which can be adjusted to any desired height through the telescoping feature. The hooks 4, 5 and 6 allow the participant to adjust the height of the jump rope 16 according to their level of comfort and safety when jumping the jump rope 16. The telescoping pole 18 is held on a tripod 7 having movable, rotatable wheels as with the stand 14 holding the electronic box 10 and is capable of being collapsed to facilitate storage.

Referring again to FIG. 1 the system 30 of the invention has a remote control 20 with a power button 21 to turn the system 30 on and off, a speed control button 22 to set the speed of the rotating jump rope 16 slow, fast, or faster and a magic eye 23 through which power is transmitted to the electronic box 10 which receives the command from the remote control 20 through a magic eye 1 located on the electronic box 10. When the power on the remote control 20 is turned on, the magic eye 23 on the remote control 20 communicates with the magic eye 1 of the electronic control box 10 which sets the circular groove 2 on the electronic box 10 in motion to turn the jump rope 16 and creates an elliptical movement of the rope 16 to enable the participant to jump the rope 16.

The other features of the system 30 of the invention include jump rope 16 in lengths six to eight feet or more long to accommodate multiple jumpers and the rope having multi-colors which children in particular may find attractive.

In some embodiments of the invention, a clip on the electronic box 10 (not shown in this FIGURE) may be attached to a wall in lieu of attaching to the telescoping pole 12 or in the alternative, the electronic box 10 may on its own be strapped in place around a tree limb instead of the pole 12. In yet other embodiments of the invention, the second end of the jump rope 16 may be attached to a tree limb in lieu of attaching to one of the hooks on the telescoping pole 18.

The foregoing description of the invention through its FIGURE and preferred embodiments should not be construed to limit the scope of the invention. It is to be understood that the embodiments of the present invention as described herein do not limit any application or scope of the invention and that the invention can be carried out and practiced in various ways and implemented in embodiments other than the ones outlined in the summary of the invention and the detailed description above accompanied by the FIGURE showing the various devices of the system. It is to be further understood that the phraseology and terminology used to describe the invention are for descriptive purposes only. It should be understood and obvious to one skilled in the art that alternatives, modifications, and variations of the embodiments of the present invention may be construed as being within the spirit and scope of the appended claims.

What is claimed is:

1. A system for jumping rope comprising:

a rope member;

an electronic box structure member mounted on a top end of a first telescoping pole structure member;

said first telescoping pole structure member having a bottom end mounted on a top end of a stand structure member, wherein said first telescoping pole structure member has a central pivot section that is configured to be folded down with the electronic box structure member for compact storage;

wherein said stand structure member has a plurality of rotating wheel members on a bottom end of said stand structure member;

said electronic box structure member comprising a circular groove structure holding a hook member to hook a first end of the rope member, a second telescoping pole structure member having a plurality of hooks to hook a second end of said rope member;

said second telescoping pole structure member mounted on a tripod structure member having a plurality of rotating wheel members on a bottom end of said tripod structure member; and a remote control member having an eye structure to communicate a command to said electronic box structure member through an eye structure located on said electronic box structure member to rotate said circular groove structure on said electronic box structure member to turn said rope member held by its first end by said hook member on said circular groove structure and by its second end by one of said plurality of hooks on said second telescoping pole structure member.

2. The system of claim 1 wherein the first telescoping pole structure member is configured to be adjusted to any height.

3. The system of claim 1 wherein said second telescoping pole structure member is configured to be adjusted to any height and is collapsible to facilitate storage.

4. The system of claim 1 wherein the electronic box structure member has a clip configured to attach said electronic box structure member to a wall instead of attached to said first telescoping pole structure member.

5. The system of claim 1 wherein the electronic box structure member is configured to be strapped around a tree limb instead of attached to said first telescoping pole structure member.

6. The system of claim 1 wherein the rope member has a length of at least six feet.

7. The system of claim 1 wherein the rope member is of different colors.

* * * * *